US011717032B2

(12) United States Patent
Hierholzer

(10) Patent No.: US 11,717,032 B2
(45) **Date of Patent: *Aug. 8, 2023**

(54) UNDERWEAR GARMENT

(71) Applicant: PIFE, Inc., Winter Springs, FL (US)

(72) Inventor: Creighton Hierholzer, Winter Springs, FL (US)

(73) Assignee: PIFE, Inc., Winter Springs, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/886,905

(22) Filed: Aug. 12, 2022

(65) Prior Publication Data

US 2022/0386710 A1 Dec. 8, 2022

Related U.S. Application Data

(63) Continuation of application No. 16/945,234, filed on Jul. 31, 2020, now Pat. No. 11,439,190, which is a continuation of application No. 16/389,803, filed on Apr. 19, 2019, now Pat. No. 10,750,792.

(60) Provisional application No. 62/661,290, filed on Apr. 23, 2018.

(51) Int. Cl.
*A41B 9/02* (2006.01)

(52) U.S. Cl.
CPC ..... *A41B 9/023* (2013.01); *A41B 2400/60* (2013.01)

(58) Field of Classification Search
CPC ..... A41B 9/023; A41B 2400/60; A41B 9/002
See application file for complete search history.

(56) References Cited

U.S. PATENT DOCUMENTS

| | | | | |
|---|---|---|---|---|
| 587,549 | A | 8/1897 | Thrower | |
| 4,195,630 | A | 4/1980 | Connery et al. | |
| 5,875,495 | A | 3/1999 | Thrower | |
| 7,788,739 | B1 | 9/2010 | Ratta | |
| 8,782,817 | B2 | 7/2014 | Gu | |
| 10,750,792 | B2 | 8/2020 | Hierholzer | |
| 11,439,190 | B2 * | 9/2022 | Hierholzer | A41B 9/023 |
| 2006/0000008 | A1 | 1/2006 | Chong | |
| 2013/0219591 | A1 | 8/2013 | Gu | |
| 2021/0000190 | A1 | 1/2021 | Kim | |

* cited by examiner

*Primary Examiner* — Tajash D Patel
(74) *Attorney, Agent, or Firm* — HEA Law PLLC; Darrin Auito

(57) ABSTRACT

A garment that includes a main body, a waistband positioned along an upper side of the main body, and a pouch positioned centrally and frontally on the main body with respect to the user. The pouch includes an auxiliary pouch, an orifice panel forming an orifice, and a hood covering the orifice panel from an outside surface thereof. The auxiliary pouch is configured to accommodate a first anatomical part of the user. The orifice is configured to accommodate insertion of a second anatomical part of the user therethrough into a separated space. The separated space is defined an outside surface of the orifice panel and an inside surface of the hood. The hood is attached to said garment at a top side of the hood and upper portions of both lateral sides of the hood. A bottom side of the hood is not directly attached to the garment.

15 Claims, 10 Drawing Sheets

UNDERWEAR GARMENT

CROSS-REFERENCE TO RELATED APPLICATIONS

This application claims priority to and is a continuation application of U.S. application Ser. No. 16/945,234, filed on Jul. 31, 2020, which is a continuation of U.S. application Ser. No. 16/389,803, filed on Apr. 19, 2019 (now U.S. Pat. No. 10,750,792), which claims benefit of U.S. Provisional App. No. 62/661,290, filed on Apr. 23, 2018. The above-mentioned patent applications are incorporated herein by reference in their entirety.

FIELD OF THE INVENTION

The present invention relates to an article of apparel but, more specifically and in a preferred form, to a pair of men's underwear, a set of boxers or briefs, having a pouch structure designed to physically separate the penis from the scrotum.

BACKGROUND OF THE INVENTION

Men's underwear generally consists of a cloth portion which covers the male genitalia in the front, the hips on the sides, and the buttocks in the rear. Today, most men's underwear is made from cotton or a cotton composition but the present invention is not limited to any particular formulation of modal, cloth, cotton, synthetic, mesh, or natural fiber and extends to any combination or composition of apparel fabric.

Traditional boxer briefs and briefs which cling tightly to the body can cause unpleasant restriction of the penis and scrotum. Briefs exist that are designed with a pouch to provide a space for loosely enclosing a wearer's penis and scrotum therein, so that the surfaces of the penis and scrotum are isolated from the wearer's skin at the crotch and thighs. However, this design causes discomfort and poor hygienic conditions because the penis and scrotum remain in physical contact. For example, sweat and drops of urine may coat the organs, contributing to discomfort, embarrassment (e.g., droplet marks), and unhygienic conditions. Briefs exist that are designed with a separated space to receive the penis. However, including a separated space alone fails to solve the above problems, e.g., restricting, difficult to access the separated space, and does not eliminate the embarrassment factor.

SUMMARY OF THE INVENTION

One objective of the present invention is to provide a garment (brief) 10 with a pouch for receiving a wearer's penis and scrotum in two easily accessible separated spaces. The separated space for the penis is formed between a hood element and a panel of the garment forming an orifice (e.g., generally circular hole). The orifice is formed in a central front portion of the garment (generally elastic) and is designed to permit a wearer to position his penis through the orifice and into a separated space formed in the garment, the separated space designed to accommodate the penis and keep the penis "free" from the rest of his body. The shape of the orifice and the height it is positioned is configured to allow the penis to smoothly enter the separated space when the garment is being put on in a way that prevents the penis from falling out of the separated space. Therefore, the scrotum remains in its normal position, always physically separated from the penis.

The hood element (e.g., flap) is attached (e.g., stitched) to the central front portion of the garment and is positioned to overlap (cover) an outside surface of the orifice when the hood is in a normal position (downward). The hood is designed to provide maximum comfortability, protection, and ease of access to both (a) an inside portion of the orifice and (b) the separated space formed between an outside of the orifice and the inside surface of the hood. In addition, the hood design simplifies fabrication and thus lowers the fabrication costs (e.g., compared to design having front inner and outer inserts described in U.S. Pat. No. 8,800,064).

One embodiment of the invention is of an underwear garment that comprises a main body having two leg holes, the main body defining a main volume configured to house a pelvic zone of a user, a waistband positioned along an upper side of the main body, the waistband configured to extend around a lower torso of the user, and a pouch positioned centrally and frontally on the main portion with respect to the user. The pouch comprises an auxiliary pouch, an orifice panel forming an orifice, and a hood covering the orifice panel from an outside surface thereof. The auxiliary pouch is configured to accommodate a first anatomical part of genitals of the user. The orifice is configured to accommodate insertion of a second anatomical part of genitals of the user therethrough into a separated space positioned outside the auxiliary pouch. The separated space is defined by an outside surface of the orifice panel of the underwear garment and an inside surface of the hood. The first anatomical part (e.g., scrotum) is different than the second anatomical part (e.g., penis).

According to another aspect, the hood is attached to said underwear garment at a top side of the hood and upper portions of both lateral sides of the hood.

According to another aspect, a bottom side of the hood is not directly attached to the underwear garment.

According to another aspect, 20-40% of a total length of each of the lateral sides of the hood is directly attached to the underwear garment, and the remaining portion of each of the lateral sides of the hood is not directly attached to the underwear garment.

According to another aspect, an absorbent panel attached to the hood.

According to another aspect, the absorbent panel is a double-lined absorption panel configured to reduce penetration of liquid outside the hood.

According to another aspect, the hood is configured such that the user can pull the lower portion thereof over the second anatomical part extending into the separated space.

According to another aspect, a top side of the main body is secured within the waistband, and a top side of the hood is secured within the waistband.

According to another aspect, a bottom panel section is included, and the bottom panel section is connected between the front and back panel sections of the main body, wherein the auxiliary pouch is attached to the main body and extends from the bottom panel section to the orifice panel.

According to another aspect, the auxiliary pouch is designed to pucker when said garment is pulled upward and thereby form a space therein to accommodate the first anatomical part.

According to another aspect, the second anatomical part can move in lateral direction while positioned inside the separated space.

According to another aspect, the pouch is formed of a material comprised of a quick dry modal material.

According to another aspect, the orifice is generally circular.

According to another aspect, an internal space of the auxiliary pouch is separated from the separated space, thereby preventing the first anatomical part from contacting the second anatomical part.

Another embodiment of the invention is a pouch for a male garment. The pouch comprises an auxiliary pouch attached to the garment, an orifice panel forming an orifice, the orifice panel attached to the garment, and a hood covering the orifice panel from an outside surface thereof. The auxiliary pouch is configured to accommodate a first anatomical part of genitals of a user. The orifice is configured to accommodate insertion of a second anatomical part of genitals of the user therethrough into a separated space positioned outside the auxiliary pouch. The separated space is defined by an outside surface of the orifice panel and an inside surface of the hood. The hood is attached to said garment at a top side of the hood and upper portions of both lateral sides of the hood and a bottom side of the hood is not directly attached to the garment. An internal space of the auxiliary pouch is separated from the separated space, thereby preventing the first anatomical part from contacting the second anatomical part.

BRIEF DESCRIPTION OF THE DRAWINGS

The following drawings illustrate examples of various components of the invention disclosed herein, and are for illustrative purposes only.

DETAILED DESCRIPTION

While the present invention may be embodied in many different forms, a number of illustrative embodiments are described herein with the understanding that the present disclosure is to be considered as providing examples of the principles of the invention and such examples are not intended to limit the invention to preferred embodiments described and/or illustrated herein.

One embodiment of this invention is described below with reference to the below drawing.

Figure 1A:
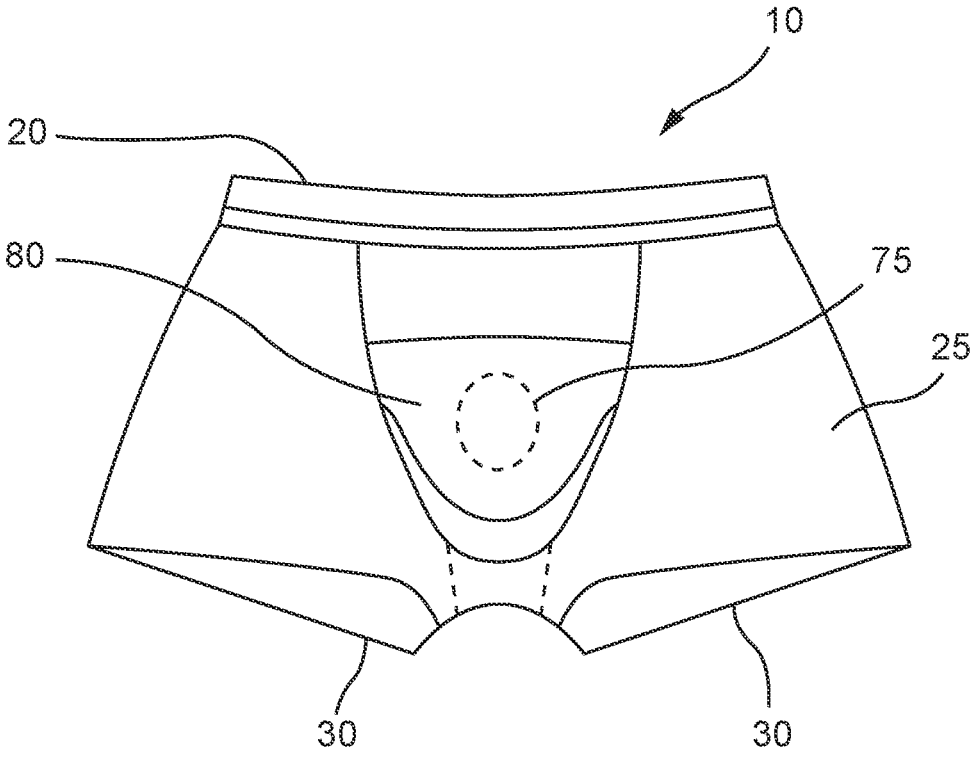
FIG. 1A is a front view of one embodiment of an underwear garment.
Figure 1B:
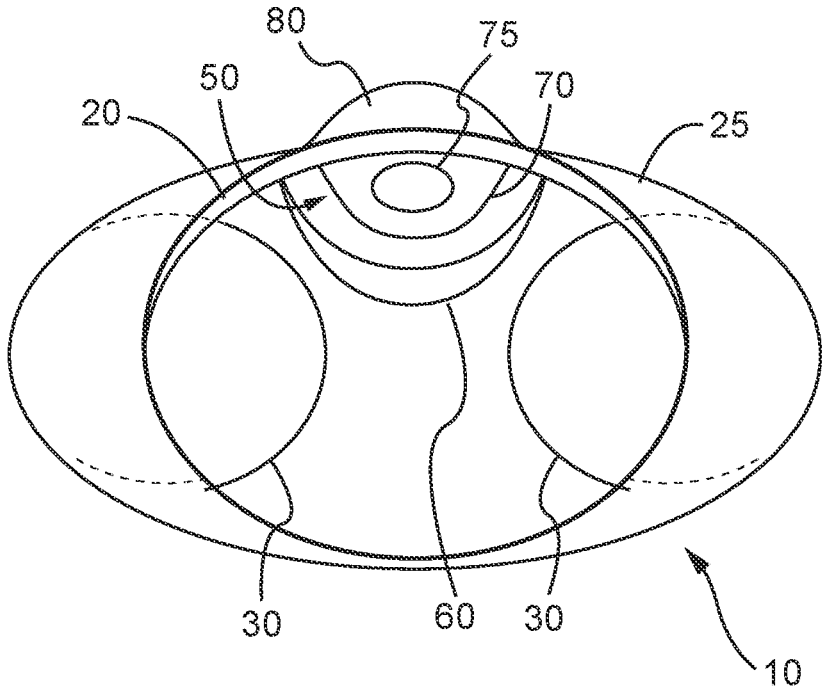
FIG. 1B is a top view of one embodiment of an underwear garment.

FIG. 1A represents one embodiment of a men's underwear garment 10 in the form of a pair of briefs. FIG. 1B represents a top view of the embodiment shown in FIG. 1A. The garment 10 is constructed similar to and includes many of the parts and components of a conventional brief.

Figure 3:
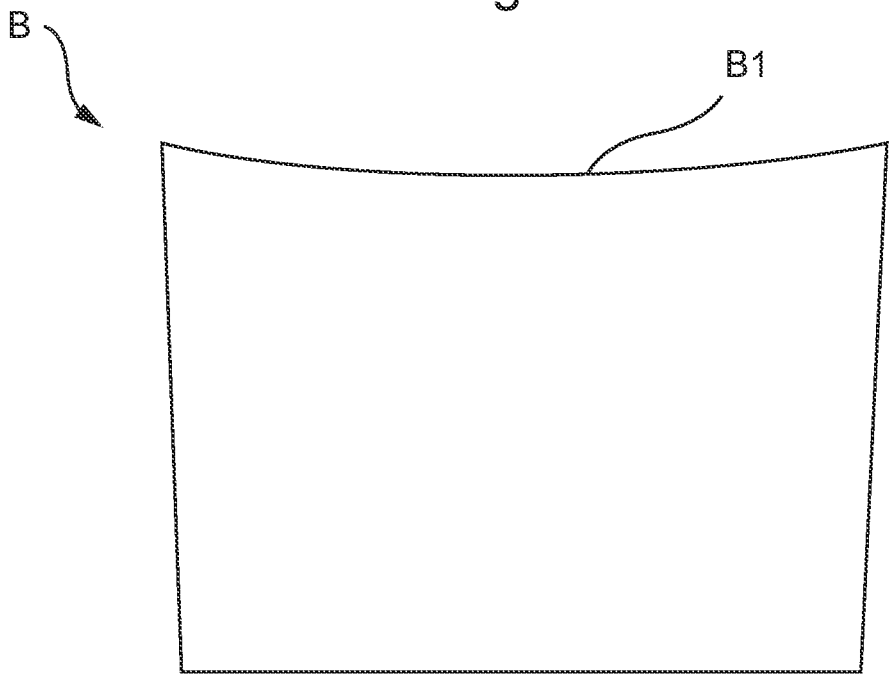
FIG. 3 is an embodiment of a pattern of a bottom crotch panel of an underwear garment.
Figure 9:
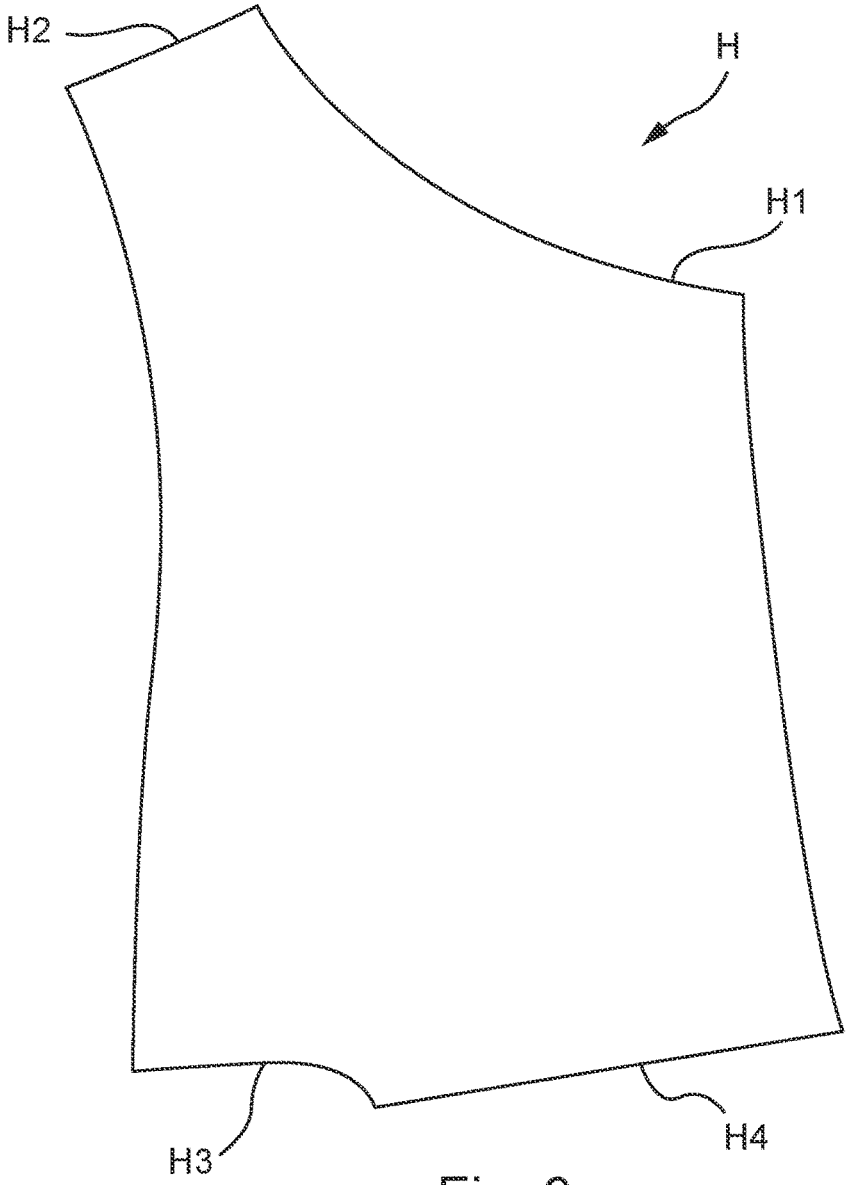
FIG. 9 is an embodiment of a pattern of a main panel (e.g., folded image) of an underwear garment.
Figure 10:
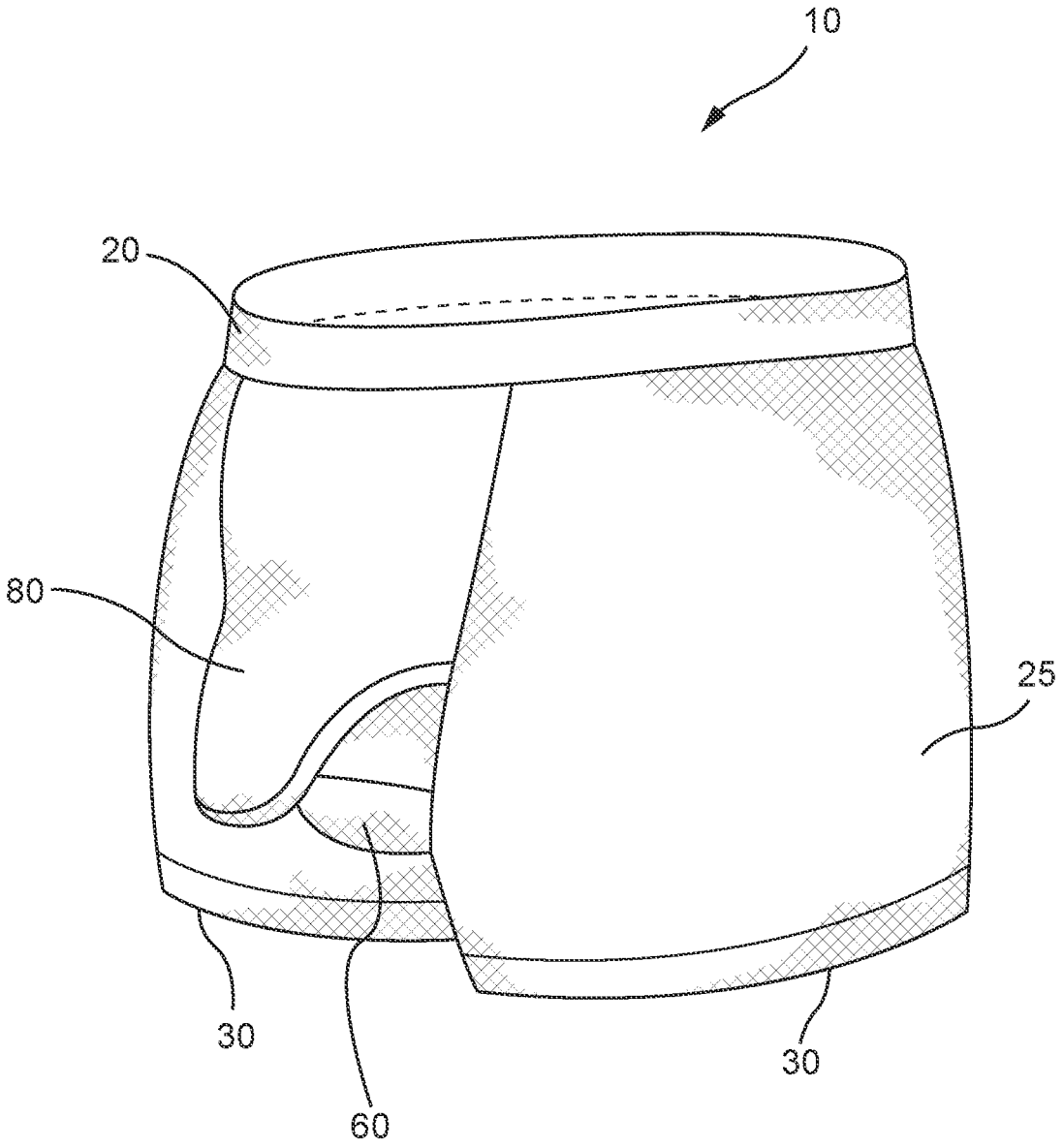
FIG. 10 is a front perspective view of an underwear garment.
Figure 11:
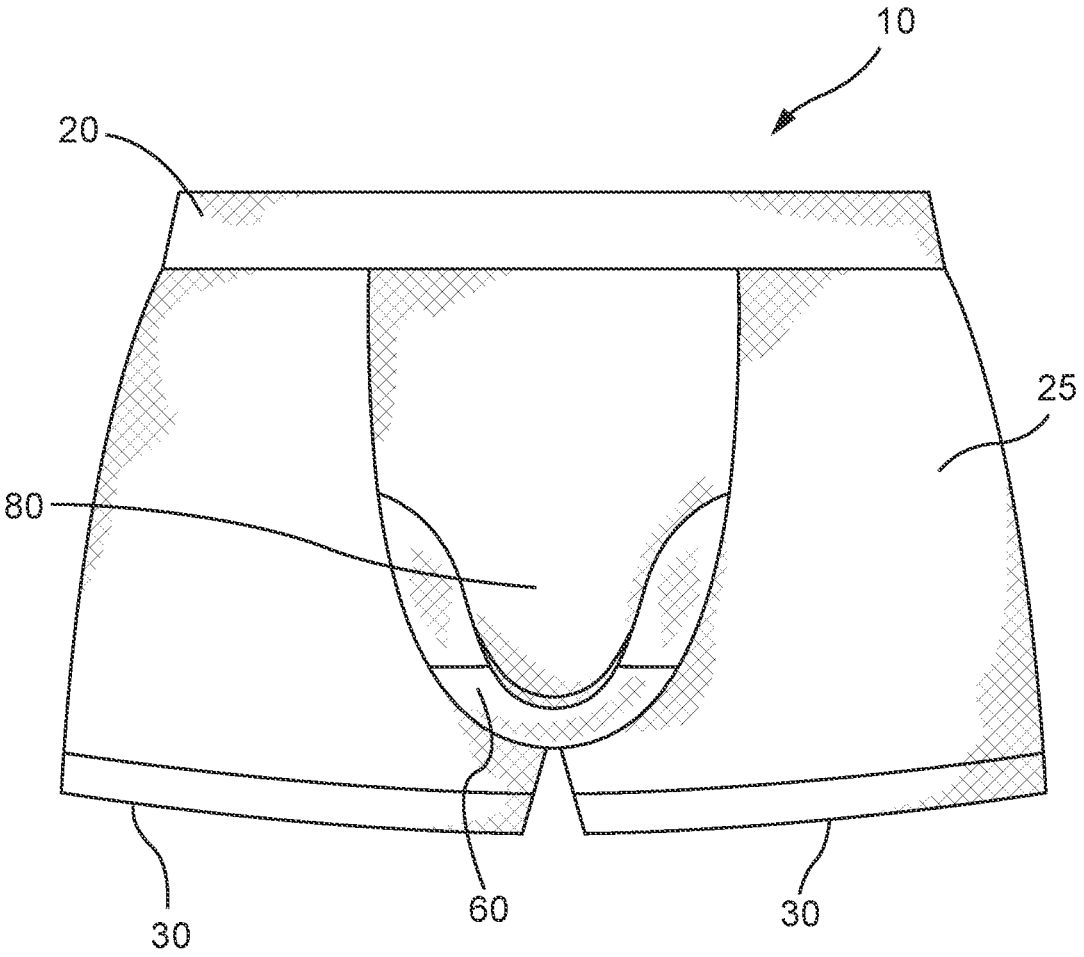
FIG. 11 is a front view of an underwear garment.
Figure 12:
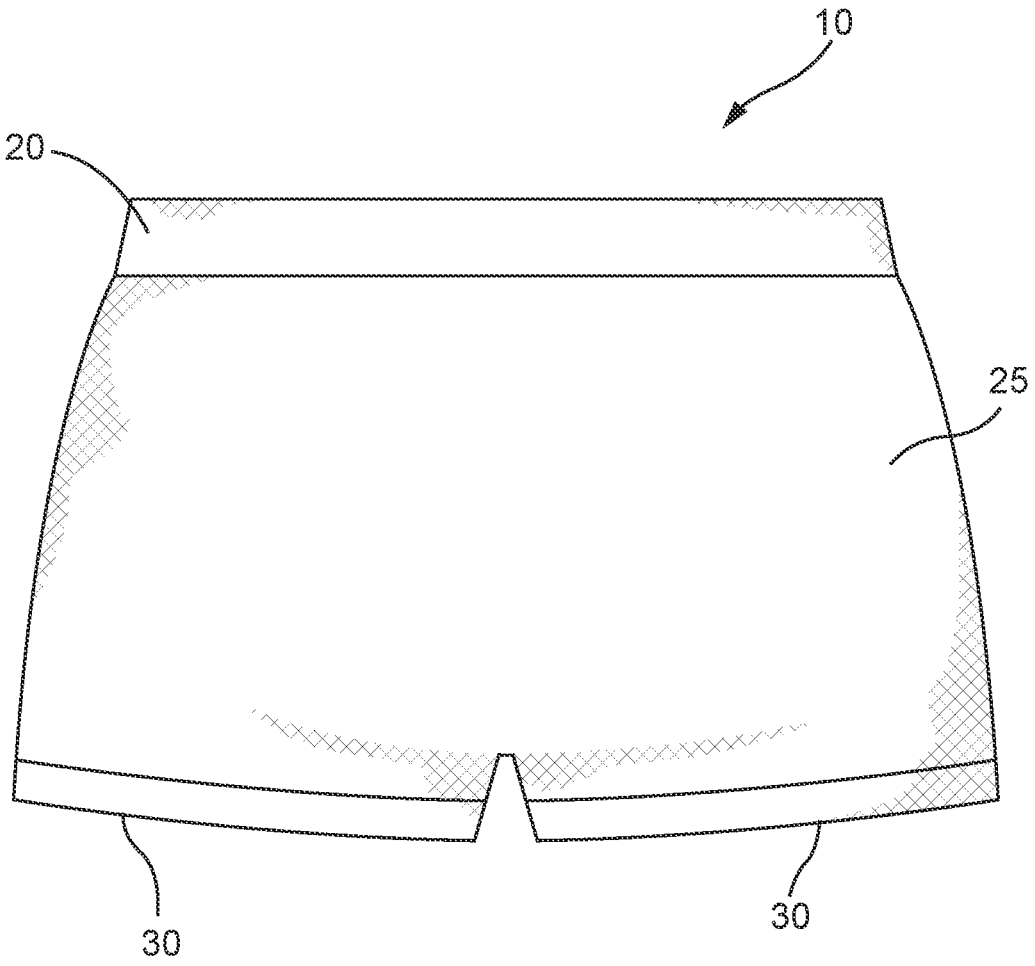
FIG. 12 is a rear view of an underwear garment.
Figure 13:
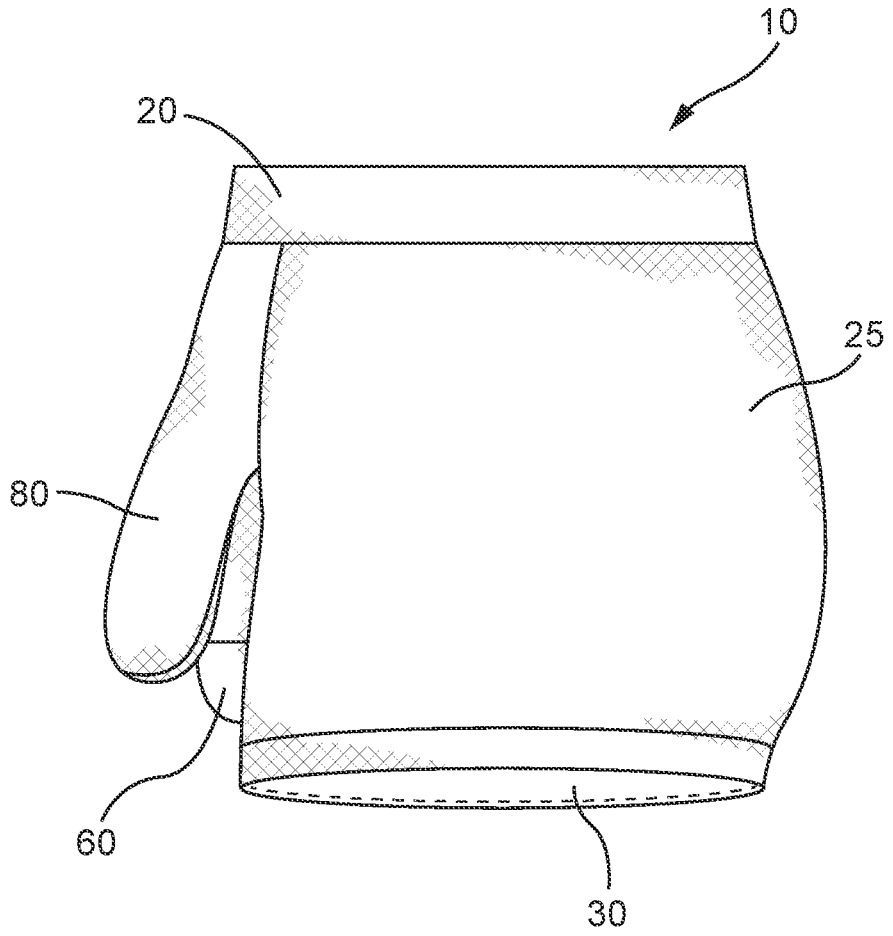
FIG. 13 is a left side view of an underwear garment.
Figure 14:
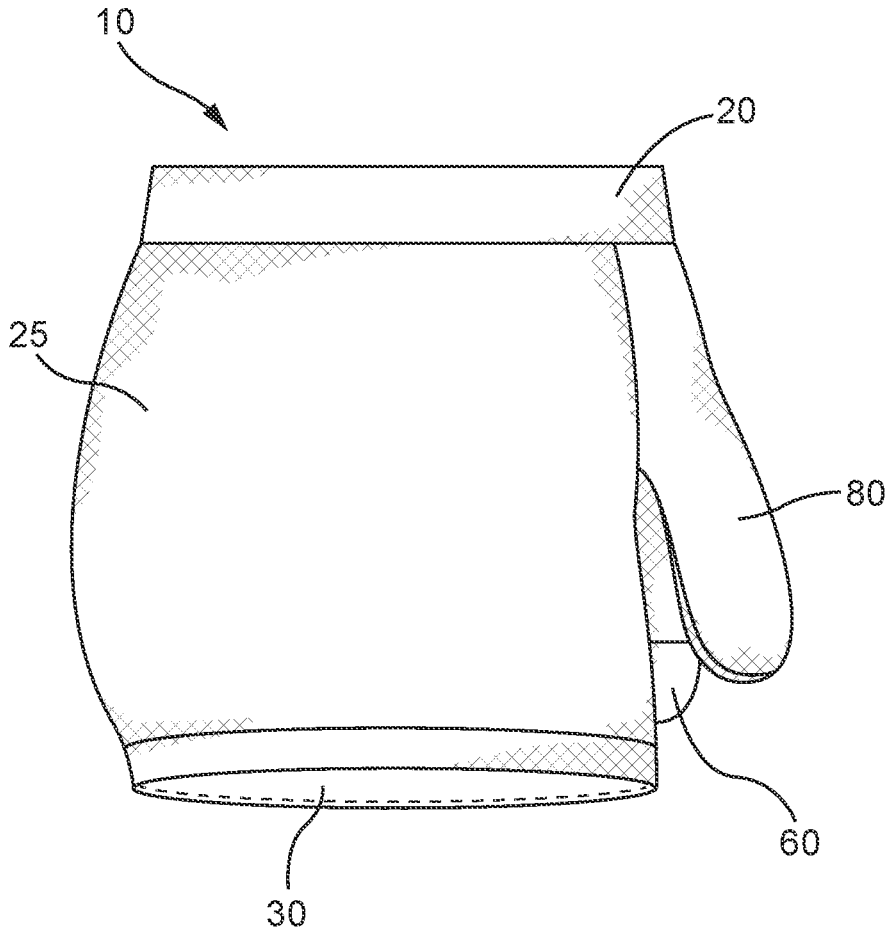
FIG. 14 is a right side view of an underwear garment.

As shown in the outside front view of FIG. 1A and the top view of FIG. 1B, aside from the hood, the brief 10 appears similar to a conventional brief from the outside. Accordingly, the brief 10 includes a main panel 25 with an elastic waist opening at the top and a pair of laterally spaced lower leg openings 30 at the bottom. The main panel 25 includes a front panel section and a back panel section. The brief also includes a bottom crotch panel section. The front and back panel sections encircle the wearer, and the bottom crotch panel section is connected between the front and back panel sections. One embodiment of the main panel 25 is illustrated in pattern H shown in FIG. 9. In this embodiment, the pattern H is illustrated in a folded state along side H4. One embodiment of the bottom crotch panel section is illustrated in pattern B shown in FIG. 3. The back, sides, and bottom crotch portions may be constructed either from a single piece of material, or from multiple pieces of material sewn together.

The brief 10 comprises waistband 20 configured to extend around the lower torso of the wearer. Generally, the elastic waistband 20 has a height of about ½ of an inch to about 2 inches. According to one embodiment, the waistband is designed as a no roll low elastic waistband 20, so that it does not show over the pants of the wearer. However, the invention is not limited to no roll elastic waistbands or low waistband garments. The sections of the main body are secured within the elastic waistband 20.

Figure 2:
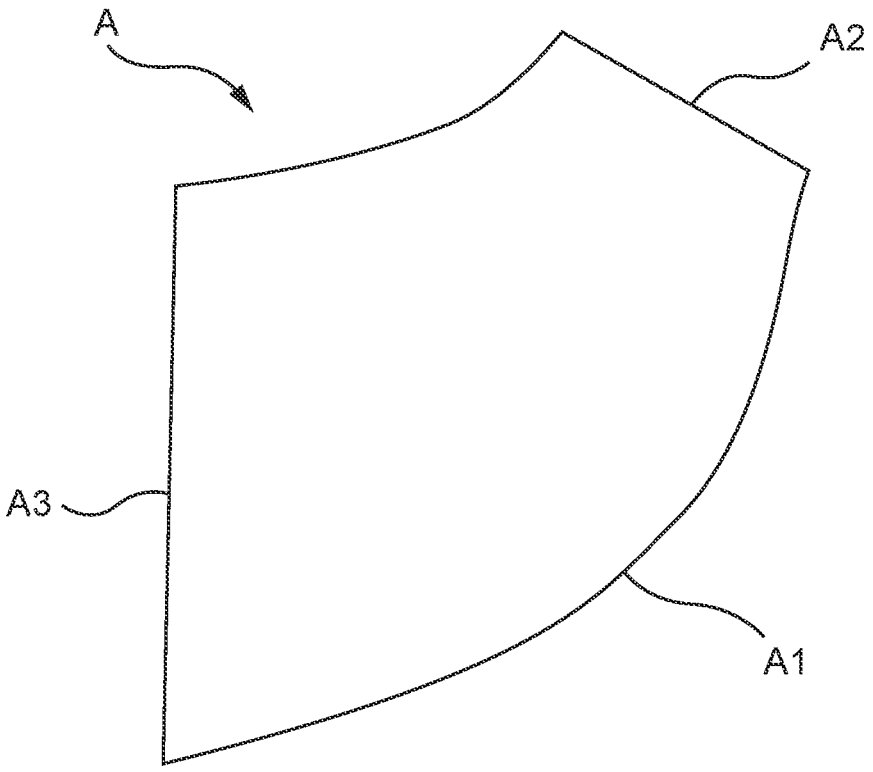
FIG. 2 is an embodiment of a pattern of a scrotum panel of an underwear garment.

The brief 10 is provided with an integrated pouch 50 for receiving a wearer's penis (e.g., second anatomical part) while allowing the scrotum (e.g., first anatomical part) to easily rest in an auxiliary pouch so that the scrotum is positioned away from the inner and upper thighs and the scrotum and penis are separated from each other. The upper portion of the hood 80 is held or secured to the underwear 10 along a length of the front of the wearer's waistband. This allows a lower portion of the hood 80 to easily pull over the head of the wearer's penis. The pouch 50 comprises a scrotum pouch 60 formed from a scrotum panel A, an orifice panel 70 forming an orifice 75, and a hood 80 covering the orifice panel on an outside surface thereof. One embodiment of the scrotum pouch 60 is illustrated in pattern B shown in FIG. 2. In this embodiment, two scrotum panels B are cut to form the scrotum pouch 60. These elements may be made of a material, e.g., quick dry modal material, that can be penetrated by air or moisture.

Figure 4:
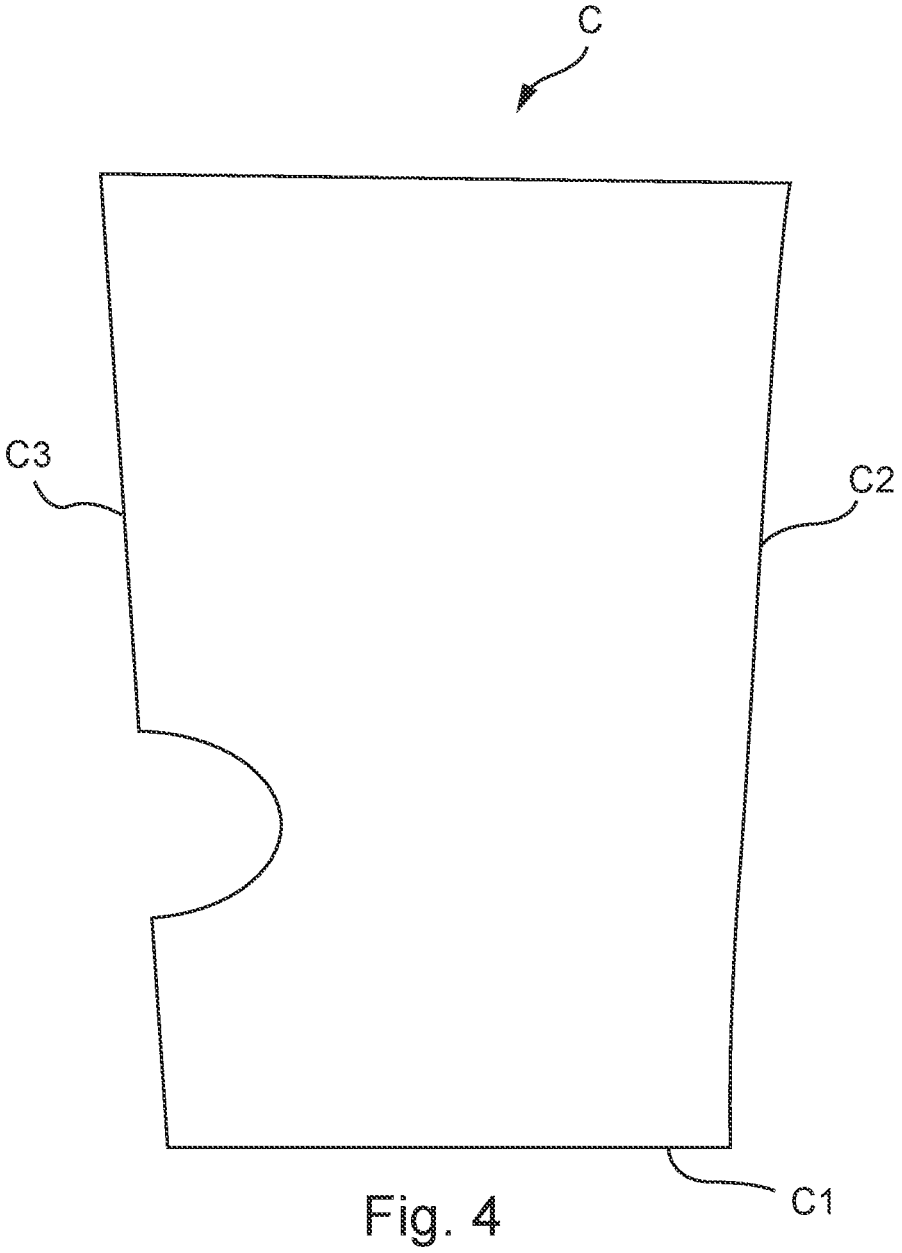
FIG. 4 is an embodiment of a pattern of an orifice panel (e.g., folded image) of an underwear garment.
Figure 5:
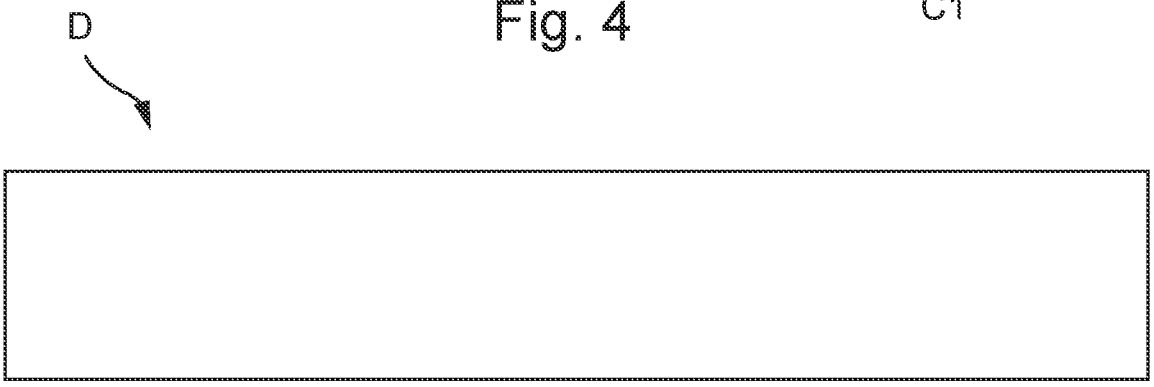
FIG. 5 is an embodiment of a pattern of a facing of the orifice panel of an underwear garment.

The orifice 75 is generally circular and positioned to accommodate the insertion of a penis through the orifice 75 and into a separated space 88 (e.g., outside the scrotum pouch and defined by an outside surface of the orifice panel 70 of the brief 10 and inside surface of the hood 80) when the brief 10 is being put on in a way that prevents the penis from falling out of the separated space 88. One embodiment of the orifice panel 70 is illustrated in pattern C shown in FIG. 4. In this embodiment, the pattern C is illustrated in a folded state along side C3 (e.g., unfolded state would depict a generally circular orifice). The orifice 75 may be off centered and the size of the orifice 75 may be adjustable to encircle the penis.

The scrotum pouch 60 is designed to pucker when two pieces of material are sewn together. The scrotum pouch 60 may be constructed either from a single piece of material, or from multiple pieces of material sewn together. The scrotum pouch 60 is attached to the main panel 25 and extends from the bottom crotch panel section to the orifice panel 70. The scrotum pouch 60 is separate from the separated space 88 that is formed, due to stitch position and pattern design, when the garment 10 is pulled upward, and is designed to allow the scrotum to be positioned in a space (e.g., scrotum pouch 60) physically separated from the separated space 88. Since the waistband 20 is not exposed (e.g., low elastic waistband design), a wearer can pull the seam at the scrotum up all the way to the body, thereby separating the scrotum from direct contact with the legs.

Figure 7:
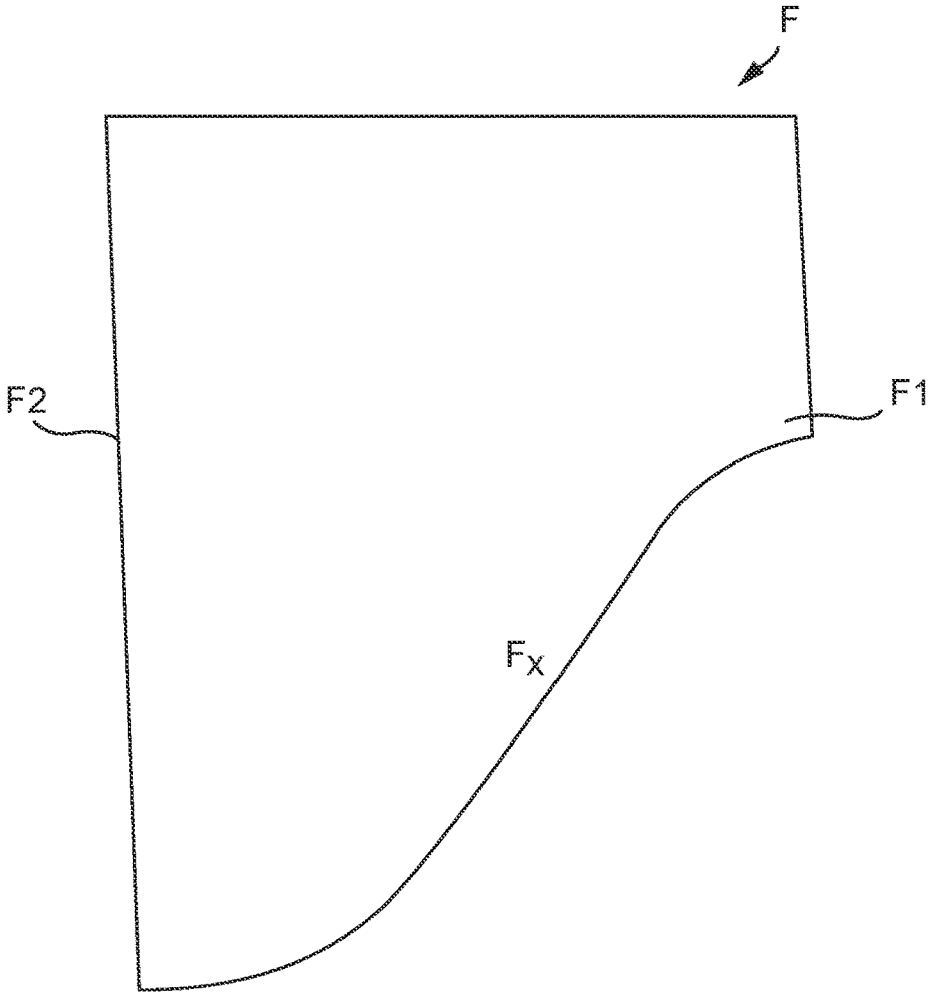
FIG. 7 is an embodiment of a pattern of a hood panel (e.g., folded image) of an underwear garment.
Figure 8:
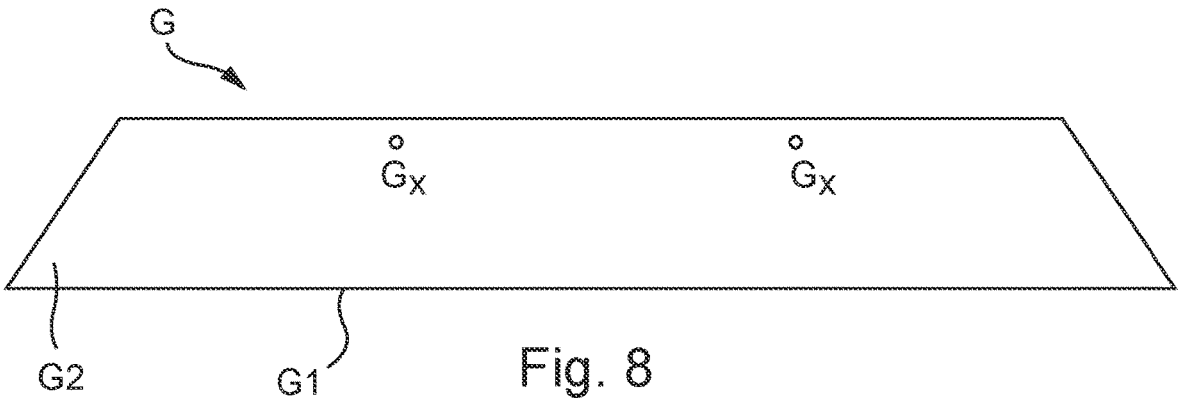
FIG. 8 is an embodiment of a pattern of a facing of the hood panel of an underwear garment.

Both lateral sides of the hood 80 (e.g., flap) are attached to the main panel 25 via a seam at an upper portion thereof. A top side of the hood 80 may be secured to the brief 10 within the elastic waistband 20. A bottom side of the hood 3 is not attached to the brief 10. A lower portion of both lateral sides of the hood 80 are not attached to the main panel. In one embodiment, for example, only the top 30% of a total length of the hood is directly attached to the underwear garment, and the remaining 70% of the total length of the hood is not directly attached. However, these percentages could change (e.g., 10% and 90%, 20% and 80%; 40% and 60%) without deviating from the design objective, which is to allow the hood 80 to flap outside of the main panel 25. Thus, the hood 3 can be easily lifted up to provide access to the penis in the separated space 88. Further, unlike conventional briefs, this integrated pouch 50 design enables the penis to move in the separated space 88, rather than being constricted inside the main panel or interior section of the briefs 10. One embodiment of the hood 80 is illustrated in pattern F shown in FIG. 7. In this embodiment, the pattern C is illustrated in a folded state along side F2.

Figure 6:
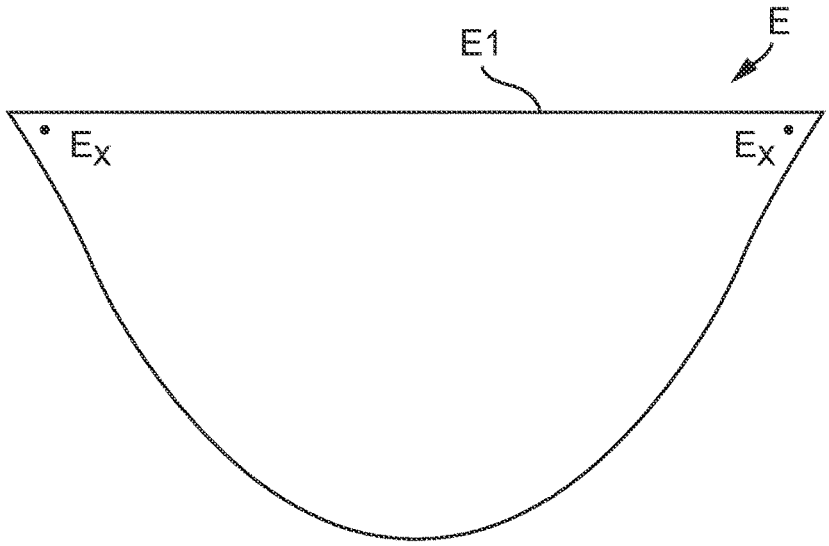
FIG. 6 is an embodiment of a pattern of an absorbent panel (e.g., folded image) of an underwear garment.

The hood 80 may include an absorbent panel 85 attached to the hood. One embodiment of the absorbent panel 85 is illustrated in pattern E shown in FIG. 6. In this embodiment, the pattern E is illustrated in a folded state along side μl (e.g., unfolded state would depict a generally oblong or football-like shape). The absorbent panel 85 may be a double-lined absorption tip configured to reduce or eliminate the "dribble effect" through clothing following urination or release of other bodily fluids.

The garment 10 comprises a shortened leg 5 design. However, the invention is not limited to shortened leg garments. This is an advantage over other boxer style designs, because the leg portion of conventional boxer style garments typically rides up a wearer's leg and bunches up, thereby putting unnecessary and excessive pressure on the scrotum.

The fabric of the garment 10 is comprised of a blend of modal and spandex, however, other fabrics, such as cotton and nylon, may be used.

FIGS. 10-14 illustrate one embodiment of the garment 10 showing how it would be positioned while being worn.

One embodiment of this invention is described below with reference to FIGS. 2-9, which are photographs of pattern pieces with accompanying cut direction descriptions.

One embodiment of a fabrication method for an underwear garment 10 of FIG. 1 and having the pattern pieces shown in FIGS. 2-9 is described below. One of ordinary skill in the art would know that these steps can be performed in different orders, that the listed dimensions can vary, and that the below order is a description of one embodiment.

Step 1: Sew ⅛" seam on side A1 of scrotum pouch A, right sides of fabric together. Step 2: Bottom crotch panel B sew ⅛" seam on side B1 to side A2.

Step 3: Orifice panel C sew ⅛" seam on side C1 to side A3.

Step 4: Sew orifice panel facing D to orifice panel C around orifice 75, right sides together with ⅛" seam. Turn facing inward, on front side, sew over seam.

Step 5: Absorbent panel E fold side of fabric together, sew ⅛" seam Step 6: Hood F—Pin absorbent panel E to hood F, aligning dots Ex to Fx (e.g., top of absorbent panel E in line with Fx on Hood F) Right sides together. ⅛" seam.

Step 7: Hood facing G right sides together, pin G1 at arrows F1 both sides of Hood F. Center hood G to center of absorbent panel E and match Gx to Ex—allowance of 1" gathered to form pouch. ⅛" seam, turn inward and sew on outer seam.

Step 8: Pin completed hood panel (E, F, G) to C2 and sew upside down, turn downward and sew over with ⅛" seam. Place hood side F1 in place on orifice panel C turning under the facing of pouch.

Step 9: Pin completed penis pouch unit to main panel H starting at waistband 20 side (Side One of Pattern) right sides together ¾" seam—repeat on other side.

Step 10: Pin side H2 of main panel H to side H3 of main panel H matching seams at leg. Center penis pouch unit to center of main panel H and sew ¾" seam.

Step 11: ½" leg seam.

Step 12: Sew elastic to waistband 20, ¼".

Although an embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the claims in the non-provisional application.

I claim:

1. A method of fabricating an underwear garment, comprising:

forming a main body having two leg holes, the main body defining a main volume configured to house a pelvic zone of a user;

attaching a waistband positioned along an upper side of the main body, the waistband configured to extend around a lower torso of the user, and forming a pouch and positioning the pouch centrally and frontally on the main portion with respect to the user, the pouch comprising an auxiliary pouch, an orifice panel forming an orifice, and a hood covering the orifice panel from an outside surface thereof, wherein the auxiliary pouch is configured to accommodate a first anatomical part of genitals of the user, the orifice is configured to accommodate insertion of a second anatomical part of genitals of the user therethrough into a separated space positioned outside the auxiliary pouch, the separated space is defined by an outside surface of the orifice panel of said underwear garment and an inside surface of the hood, and the first anatomical part is different than the second anatomical part.

2. The method of fabricating the underwear garment according to claim 1, comprising: attaching the hood to said underwear garment at a top side of the hood and upper portions of both lateral sides of the hood.

3. The method of fabricating the underwear garment according to claim 2, wherein a bottom side of the hood is not directly attached to the underwear garment.

4. The method of fabricating the underwear garment according to claim 3, comprising: directly attaching 20-40% of a total length of each of the lateral sides of the hood to the underwear garment, wherein the remaining portion of each of the lateral sides of the hood is not directly attached to the underwear garment.

5. The method of fabricating the underwear garment according to claim 1, further comprising attaching an absorbent panel attached to the hood.

6. The method of fabricating the underwear garment according to claim 5, wherein the absorbent panel is a double-lined absorption panel configured to reduce penetration of liquid outside the hood.

7. The method of fabricating the underwear garment according to claim 3, wherein the hood is configured such that the user can pull the lower portion thereof over the second anatomical part extending into the separated space.

8. The method of fabricating the underwear garment according to claim 1, comprising:

securing a top side of the main body within the waistband, and securing a top side of the within the waistband.

9. The method of fabricating the underwear garment according to claim 1, comprising:

connecting a bottom panel section between the front and back panel sections of the main body; and attaching the auxiliary pouch to the main body, wherein the auxiliary pouch extends from the bottom panel section to the orifice panel.

10. The method a fabricating the underwear garment according to claim 9, wherein the auxiliary pouch is designed to pucker when said garment is pulled upward and thereby form a space therein to accommodate the first anatomical part.

11. The method of fabricating the underwear garment according to claim 7, wherein the second anatomical part can move in lateral direction while positioned inside the separated space.

12. The method of fabricating the underwear garment according to claim 1, wherein the pouch is formed of a material comprised of a quick dry modal material.

13. The method of fabricating the underwear garment according to claim 1, wherein the orifice is generally circular.

14. The method of fabricating the underwear garment according to claim 1, wherein an internal space of the auxiliary pouch is separated from the separated space, thereby preventing the first anatomical pan from contacting the second anatomical part.

15. A method of fabricating a pouch for a male garment, said method comprising:

attaching an auxiliary pouch to said garment;

forming an orifice panel comprising an orifice;

attaching the orifice panel to said garment; and attaching a hood covering the orifice panel from an outside surface thereof, wherein the auxiliary pouch is configured to accommodate a first anatomical part of genitals of a user, the orifice is configured to accommodate insertion of a second anatomical part of genitals of the user therethrough into a separated space positioned outside the auxiliary pouch, the separated space is defined by an outside surface of the orifice panel and an inside surface of the hood, the hood s attached to said garment at a top side of the hood and upper portions of both lateral sides of the hood, a bottom side of the hood is not directly attached to the garment, and internal space of the auxiliary pouch is separated from the separated space, thereby preventing the first anatomical part from contacting the second anatomical part.

* * * * *